United States Patent [19]

Shibata et al.

[11] Patent Number: 4,708,456

[45] Date of Patent: Nov. 24, 1987

[54] METHOD AND APPARATUS FOR FEEDING AND CONVEYING COPYING PAPERS IN A COPYING MACHINE

[75] Inventors: Kiyoshi Shibata, Osaka; Yutaka Shigemura, Takarazuka, both of Japan

[73] Assignee: Mita Industrial Co., Ltd., Osaka, Japan

[21] Appl. No.: 20,206

[22] Filed: Feb. 27, 1987

Related U.S. Application Data

[63] Continuation of Ser. No. 699,839, Feb. 8, 1985, abandoned.

[30] Foreign Application Priority Data

Feb. 18, 1984 [JP] Japan ..... 59-31233

[51] Int. Cl.[4] ..... G03G 21/00

[52] U.S. Cl. ..... 355/3 SH; 355/14 SH; 271/227; 271/235

[58] Field of Search ..... 355/3 SH, 14 SH; 271/227, 235, 245, 246

[56] References Cited

U.S. PATENT DOCUMENTS

| | | | |
|---|---|---|---|
| 3,963,339 | 6/1976 | Taylor et al. . | |
| 4,457,614 | 7/1984 | Nakajima et al. | 355/3 SH |
| 4,548,394 | 6/1985 | Koyama et al. | 271/23 S |

FOREIGN PATENT DOCUMENTS

| | | | |
|---|---|---|---|
| 0059631 | 8/1982 | European Pat. Off. | 355/3 SH |
| 3223048 | 12/1983 | Fed. Rep. of Germany | 271/227 |
| 0180548 | 11/1982 | Japan | 271/227 |
| 0049561 | 3/1984 | Japan | 355/3 SH |

*Primary Examiner*—Arthur T. Grimley
*Assistant Examiner*—David S. Warren
*Attorney, Agent, or Firm*—Wenderoth, Lind & Ponack

[57] ABSTRACT

A copying paper is deflected at least twice in the conveying process thereof from a paper feeding means to a photoreceptor which is disposed in the lower reaches of the conveying direction, whereby the positional state of the top edge of the copying paper is corrected at least twice. Since the extent of each deflection of the copying paper can be reduced, a habit of creasing, which has been a bad influence upon the transferring process, is not inflicted on the copying paper. The correction of the position of the top of the copying paper can be accurately carried out, whereby a clear image can be formed on the appointed position of the copying paper.

3 Claims, 5 Drawing Figures

METHOD AND APPARATUS FOR FEEDING AND CONVEYING COPYING PAPERS IN A COPYING MACHINE

This application is a continuation of now abandoned application Ser. No. 699,839, filed Feb. 8, 1985.

BACKGROUND OF THE INVENTION

1. Field of the Invention

The present invention relates to an improved method and apparatus for feeding and conveying copying papers in a copying machine provided with at least two pairs of conveying rollers on a conveying passage used for transferring copying papers.

2. Description of the Prior Art

In general, an electrostatic photographic copying machine is constructed so that a copying paper 2 housed in a cassette 1 may be conveyed to the transferring position, at which a transferring apparatus 6 and the like are disposed, one by one by means of a paper-feeding roller 3 disposed in the vicinity of said cassette 1, conveying rollers 5 and 5' provided on a conveying passage 4 and the like, where an image formed on a photoreceptor 7 is transferred onto said copying paper, and then the appointed fixation may be carried out, as shown in FIG. 1.

Said conveying passage 4 is a passage from said conveying roller 5 to said photoreceptor 7.

Since the paper-feeding force of said paper-feeding roller 3 becomes unstable due to the frictional force between said copying paper 2 and said paper-feeding roller 3 when said paper-feeding roller 3 is rotated in the usual copying machine of this type, the position of the top edge of said copying paper 2, which has been conveyed to said conveying roller 5 for conveying said copying paper 2 synchronously with the drive of an optical system such that the top edge of said copying paper 2 is initially inclined. That is, the paper is in the condition in which the top edge of said copying paper 2 is not at right angles to the conveying direction but is inclined thereto. The paper position is subsequently corrected in said conveying roller 5. That is, the above described correction of the position of the top edge of said copying paper 2 is carried out by leaving a considerable space between guide plates 8 and 8' and making said copying paper 2 bend in such a manner as shown by an imaginary line 2' in FIG. 1 be engaging the pointed end of said copying paper fed from said paper-feeding roller 3 with the nipping position of said conveying roller 5 standing still.

However, since even a copying machine which has a comparatively long conveying passage 4 and at least two pairs of conveying rollers 5 and 5' which are provided on said conveying passage 4 is adapted to carry out the above described correction of the position of the top edge of said copying paper 2 by means of a pair of conveying rollers, (usually a pair of conveying rollers 5 of the upper reach side), it is necessary to make said copying paper 2 bend to a sufficiently large extent by engaging said copying paper 2' with the nipping position of said conveying rollers 5 standing still in order to correctly carry out said correction.

However, when the amount of bending (deflection) of said copying paper 2 is increased, some creases are generated on said copying paper 2', whereby the adherence of said copying paper 2' to said photoreceptor 7 is lowered, and as a result, an image cannot be distinctly transferred onto said copying paper 2'. On the other hand, when thick copying papers are used, the deflection of said copying paper to the extent required for the correction of the position of the top edge of said copying paper cannot be obtained, whereby said correction cannot be surely carried out.

SUMMARY OF THE INVENTION

It is an object of the present invention to provide a method and apparatus for feeding and conveying copying papers wherein the extent of a deflection of a copying paper is reduced by causing the deflection of a copying paper, which is being conveyed, at least two times, whereby the correction of the position of the top edge of said copying paper can be accurately carried out.

DESCRIPTION OF THE PREFERRED EMBODIMENT

The preferred embodiment of the present invention will be described below with reference to the drawings.

Figure 2:
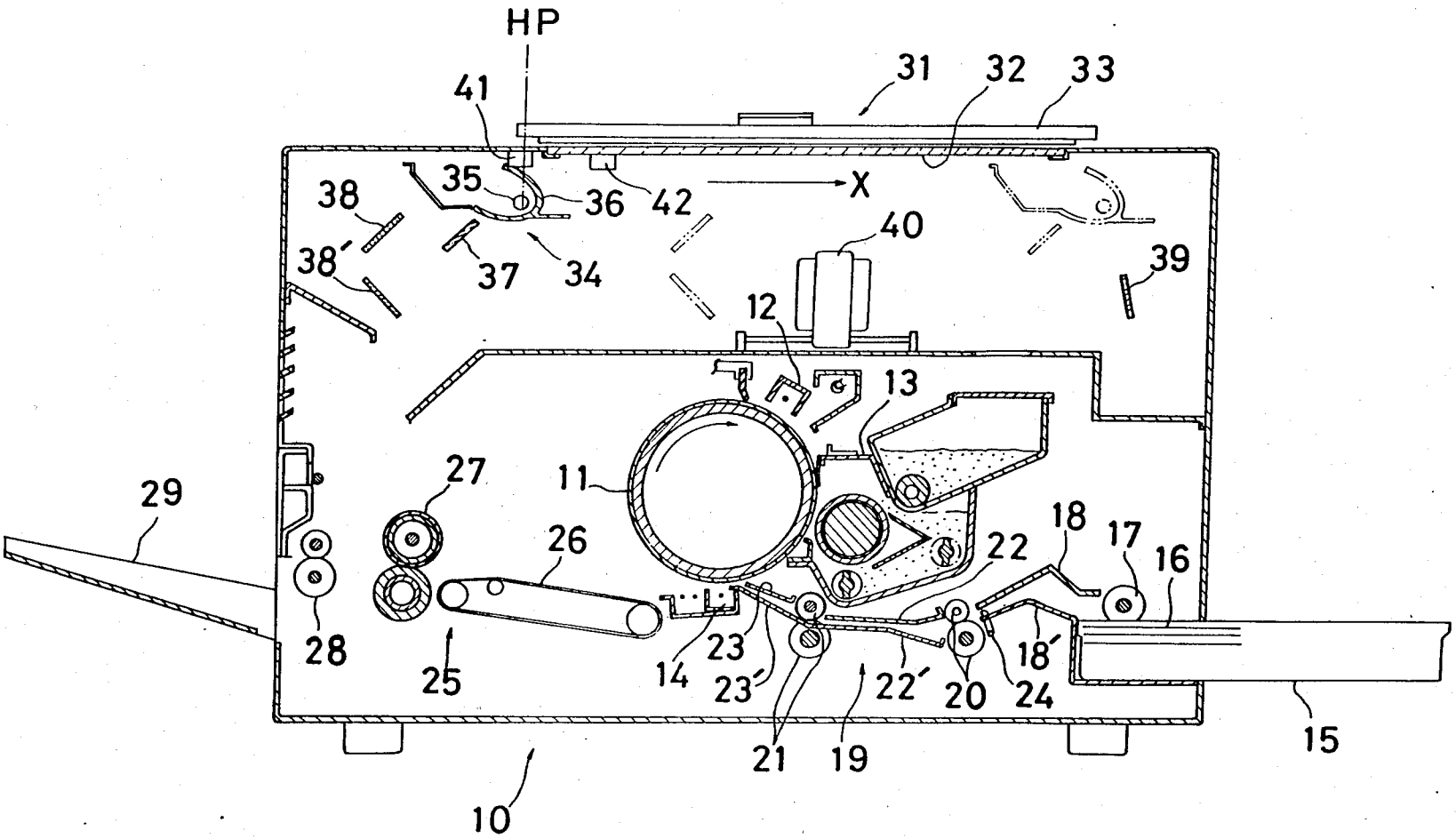
FIG. 2 is a sectional view showing an outline of a copying machine in which a paper feeding and conveying apparatus according to the present invention is used.
Figure 3:
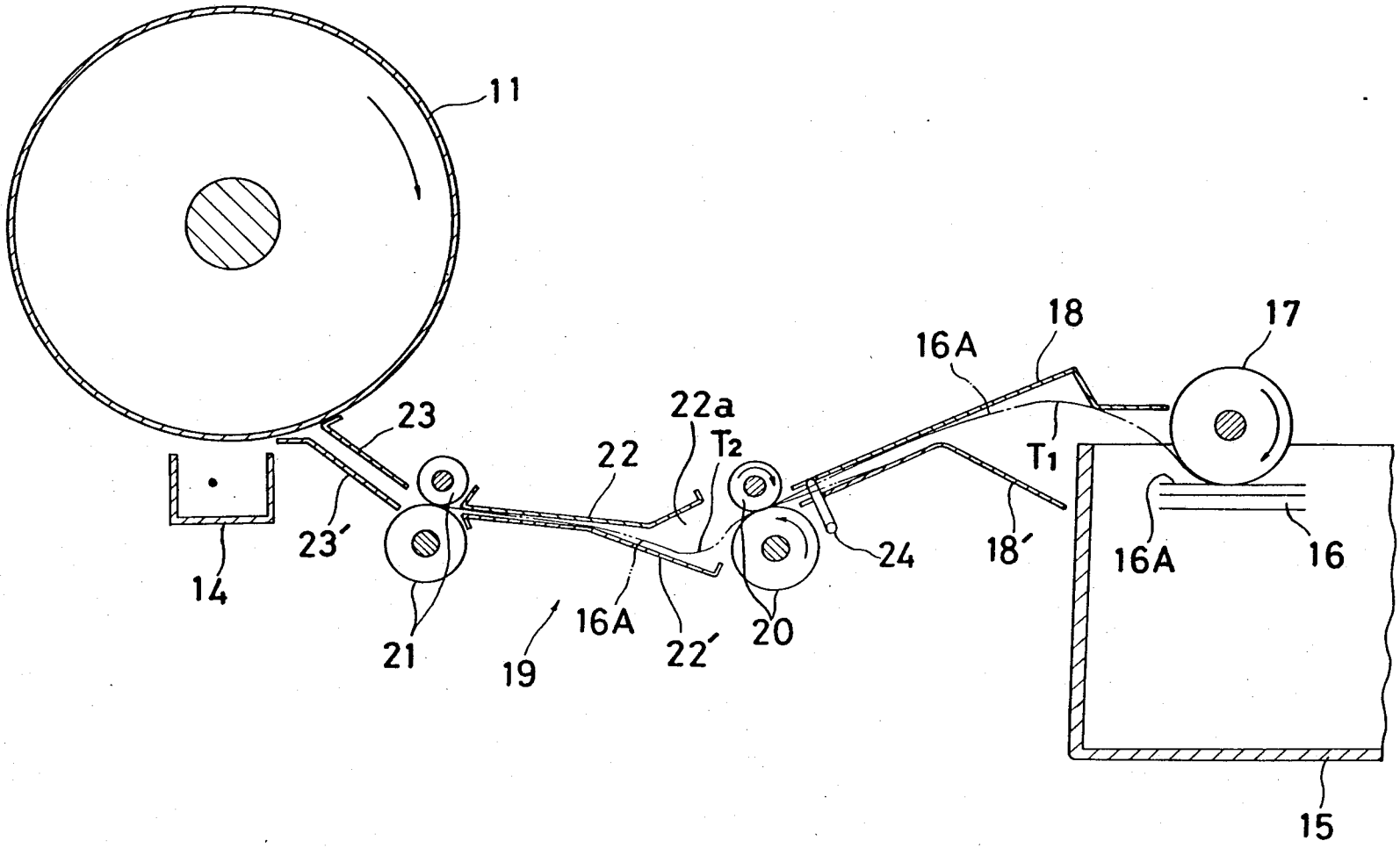
FIG. 3 is a sectional view showing the principal parts of a paper feeding and conveying apparatus according to the present invention.

FIG. 2 is a sectional view showing an outline of a copying machine 10 in which a paper feeding and conveying apparatus according to the present invention is used and FIG. 3 is a sectional view showing the principal parts of a paper feeding and conveying apparatus according to the present invention. Referring to FIGS. 2 and 3, element 11 is a right cylindrical photoreceptor. In the vicinity of said right cylindrical photoreceptor 11 is an electrifying apparatus 12, a developing apparatus 13 and a transferring apparatus 14 which are arranged in order along the rotational direction as shown by an arrow in FIG. 2. Element 15 is a cassette for housing a plurality of copying papers 16 therein, in the vicinity of which a paper feeding roller 17 is disposed.

Figure 1:
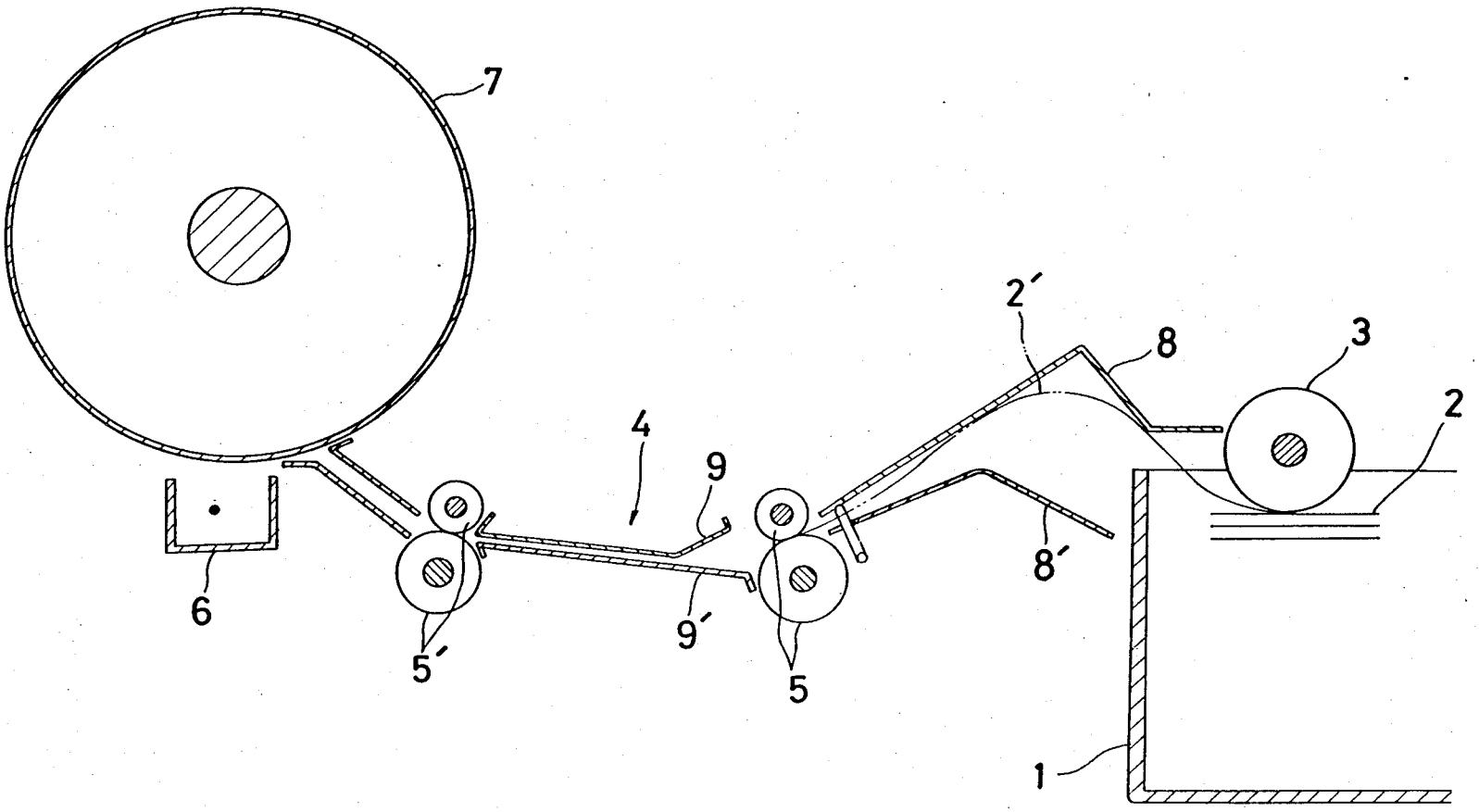
Fig.1 PRIOR ART
FIG. 1 is a sectional view showing an outline of a paper feeding and conveying apparatus in the conventional copying machine.

Elements 18 and 18' are guide plates which are arranged with a space more narrow than that between the conventional guide plates 8 and 8' of the prior art system. Element 19 is a conveying passage provided with at least two pairs of conveying rollers. In this preferred embodiment, said conveying passage 19 is provided with two pairs of conveying rollers 20 and 21. Elements 22 and 22' are guide plates adapted so that the upper reach side of said guide plate 22' may be bent downwardly contrary to that the lower plate 9' of the conventional guide plates 9 and 9' as shown in FIG. 1. The guide plates 22 and 22' are arranged so as to be almost linearly formed and a comparatively large space **22*a* may be formed at the upper reach side of said guide plate 22'. Elements 23 and 23' are guide plates disposed between said conveying roller 21 of the lower reach side and said photoreceptor 11**.

Said paper feeding roller 17, said conveying roller 20 of the upper reach side and said conveying roller 21 of the lower reach side are respectively pivoted on a rotation axis provided with a known spring clutch, so that the drive may be transmitted and disengaged by controlling said spring clutch by means of a solenoid.

Element 24 is a copying paper detector, which is disposed in the upper reaches of said conveying roller 20 of the upper reach side and near thereby, for detecting said copying paper 16 fed by said paper feeding roller 17. The copying paper detector 24 is composed of a photosensor or a microswitch, and said paper feeding roller 17 and said conveying roller 20 of the upper reach side are controlled by an output signal from said copying paper detector 24.

Element 25 is a conveying passage for conveying a copying paper, which passed through said transferring apparatus 14, and consists of a conveying belt 26, a fixing apparatus 27 consisting of a pair of pressing rollers, a discharging roller 28 or the like which is adapted to discharge a copying paper, on which an image was fixed, onto a tray 29.

Element 31 is a manuscript placing portion which is provided on the upper side of said copying machine 10 and which consists of a contact glass 32 for placing a manuscript thereon and a cover 33 for pressing said manuscript. A control panel (not shown) is disposed in the vicinity of said manuscript placing portion 31 and is provided with a print button together with a ten key input pad.

Element 34 is an optical system for exposing a manuscript and comprises a light source 35, a main reflector 36, scanning mirrors 37, 38, 38', and a reflecting mirror 39. In the preferred embodiment shown in FIG. 2, said optical system 34 is adapted to form an electrostatic latent image of an appointed magnification on the photoreceptor 11 through a lens 40 while it scans a manuscript in the direction of X from the left end to the right end thereof.

Elements 41 and 42 are detectors for the optical system 34 for outputting a signal in accordance with the operation of said optical system 34, and for example comprises microswitches or photosensors which are disposed inside the body of a copying machine at the upper portion thereof. An output of said first detector 41 for optical system is "0" when said optical system 34 is at its home position (the position for waiting for the copying operation, that is to say, the position HP designated in FIG. 2) and "1" when said optical system 34 is at a position other than said home position. In addition, said second detector 42 for the optical system 34 is disposed at a slight interval from said home position HP in the direction of X so that said conveying roller 21 of the lower reach side and said conveying roller 20 of the upper reach side may be rotated when said optical system 34 passes over said detector 42 and an output thereof turns "0" to "1".

Figure 4:
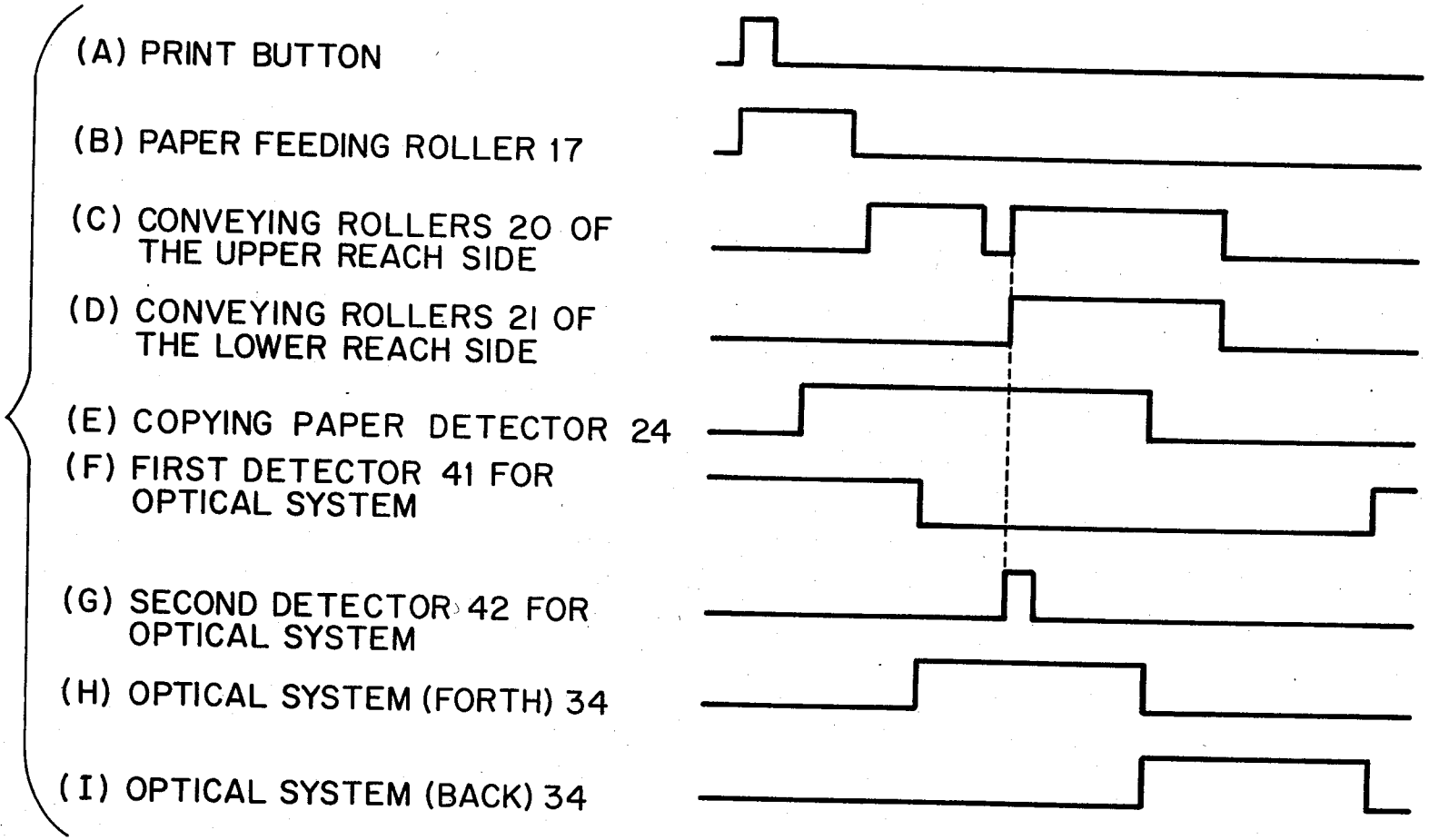
FIG. 4 is a timing chart illustrating the operation.

The operation of the preferred embodiment of the present invention constructed in the above described manner will be described below with reference to FIGS. 2 and 3 and a timing chart as shown in FIG. 4.

During the time when the copying operation is being waited for, said paper feeding roller 17, said conveying roller 20 of the upper reach side and said conveying roller 21 of the lower reach side are stopped. In the copying operation, on pressing said print button, said paper feeding roller 17 first begins to rotate in the direction shown by an arrow in FIG. 3. Along with this rotation of said paper feeding roller 17, the uppermost one 16A of said copying papers 16 housed in said paper feeding cassette 15 is sent out toward said conveying roller 20 of the upper reach side along said guide plates 18 and 18'. Said copying paper detector 24 is actuated before the pointed end of said copying paper 16A comes to a nipping position of said conveying roller 20 of the upper reach side. Since said paper feeding roller 17 continues to rotate further for a certain definite time while said conveying roller 20 of the upper reach side is stopped even though said detector 24 is actuated so as to output a detecting signal, said copying paper 16A forms the first deflection $T_1$ as shown by an imaginary line in FIG. 3. The first correction of the position of said copying paper 16A is carried out due to said first deflection $T_1$.

Then, after a certain definite time has passed from the actuation of said copying paper detector 24, said paper feeding roller 17 is stopped and after a further time, said conveying roller 20 of the upper reach side is rotated for a certain definite time in the direction shown by an arrow in FIG. 3. Said copying paper 16A is conveyed to the lower reach side of said conveying roller 20 of the upper reach side by such a rotation of said conveying roller 20 of the upper reach side and the pointed head of said copying paper 16A comes to the nipping position of said conveying roller 21 of the lower reach side through a space between said guide plates 22 and 22'. However, since said conveying roller 21 of the lower reach side stopped while said conveying roller 20 of the upper reach side continues to rotate, said copying paper 16A forms the second deflection $T_2$ as shown by an imaginary line in FIG. 3. In this case, said conveying roller 20 of the upper reach side is stopped after rotating for the appointed time, so that the extent of said second deflection $T_2$ is always constant.

Said second small deflection $T_2$ is formed by holding said copying paper 16A on said conveying roller 21 of the lower reach side, whereby the final correction of the position of said copying paper 16A is carried out and the copying operation is waited for under such a state.

On the other hand, a clutch for driving the optical system 34 is not actuated even by pressing said print button. Said optical system is not moved in the direction of X to carry out the appointed slit exposure until an appointed time has passed from the start of the actuation of said conveying roller 20 of the upper reach side. The reflected rays from a manuscript resulting from such an exposure focus into a latent image on said photoreceptor 11 through said scanning mirrors 37, 38, and 38', said lens 40 and said reflecting mirror 39.

Said second detector 42 for the optical system 34 is actuated during the time when said optical system 34 is moved in the direction of X and said conveying roller 21 of the lower reach side and said conveying roller 20 of the upper reach side begin to rotate on the basis of an output signal from said detector 42. The conveying roller 21 of the lower reach side is driven when a latent image formed on the surface of said photoreceptor 11 is developed by means of said developing apparatus 13 with the rotation of said photoreceptor 11 to form a toner image and the distance between the top of said toner image and said transferring apparatus 14 becomes equal to the distance between the top of said copying paper 16A held on said conveying roller 21 of the lower reach side and said transferring apparatus 14.

As described above, the appointed transferred image is formed on said copying paper 16A by making the timing of moving said toner image formed on said photoreceptor 11 coincide with the timing of conveying said copying paper 16A.

As described above, since said copying paper 16 fed from said cassette 15 is adapted to form said first deflection by making the top thereof contact with said conveying roller 20 of the upper reach side and then form said second deflection by making the top thereof contact with said conveying roller 21 of the lower reach side, that is to say the positional correction of the top edge of said copying paper is carried out twice, the extent of each deflection can be reduced. Accordingly, an inconvenient habit of creasing incidental to a copying paper used in the conventional copying machine can be eliminated and the adherence of said copying paper 16 to said photoreceptor 11 in the transferring process is improved, whereby a clear image can be obtained.

Although a pair of conveying rollers 20 and 21 are respectively provided in the upper reaches and the lower reaches, in the above described preferred embodiment, 3 or more pairs of conveying rollers may be provided. In such a case, if the conveying rollers most near the transferring position and the conveying rollers directly before said conveying rollers most near the transferring position are adapted to contact with a copying paper so that said copying paper may be deflected, respectively, the correction of the position of said copying paper can be carried out directly prior to the transferring process, so that a more correct correction can be achieved.

As described above, according to the present invention, since said copying paper is adapted to deflect at least twice in the transferring process thereof from the paper feeding apparatus to the lower reach side so that the extent of each deflection may be reduced, said copying paper can be prevented from generating a habit of creasing which causes a bad influence upon the transferring process, whereby the correction of the position of said copying paper can be accurately carried out. As a result, a clear image can be formed at the appointed position on a copying paper.

One preferred embodiment of an electrical circuit according to the present invention is described with reference to FIG. 5.

Figure 5:
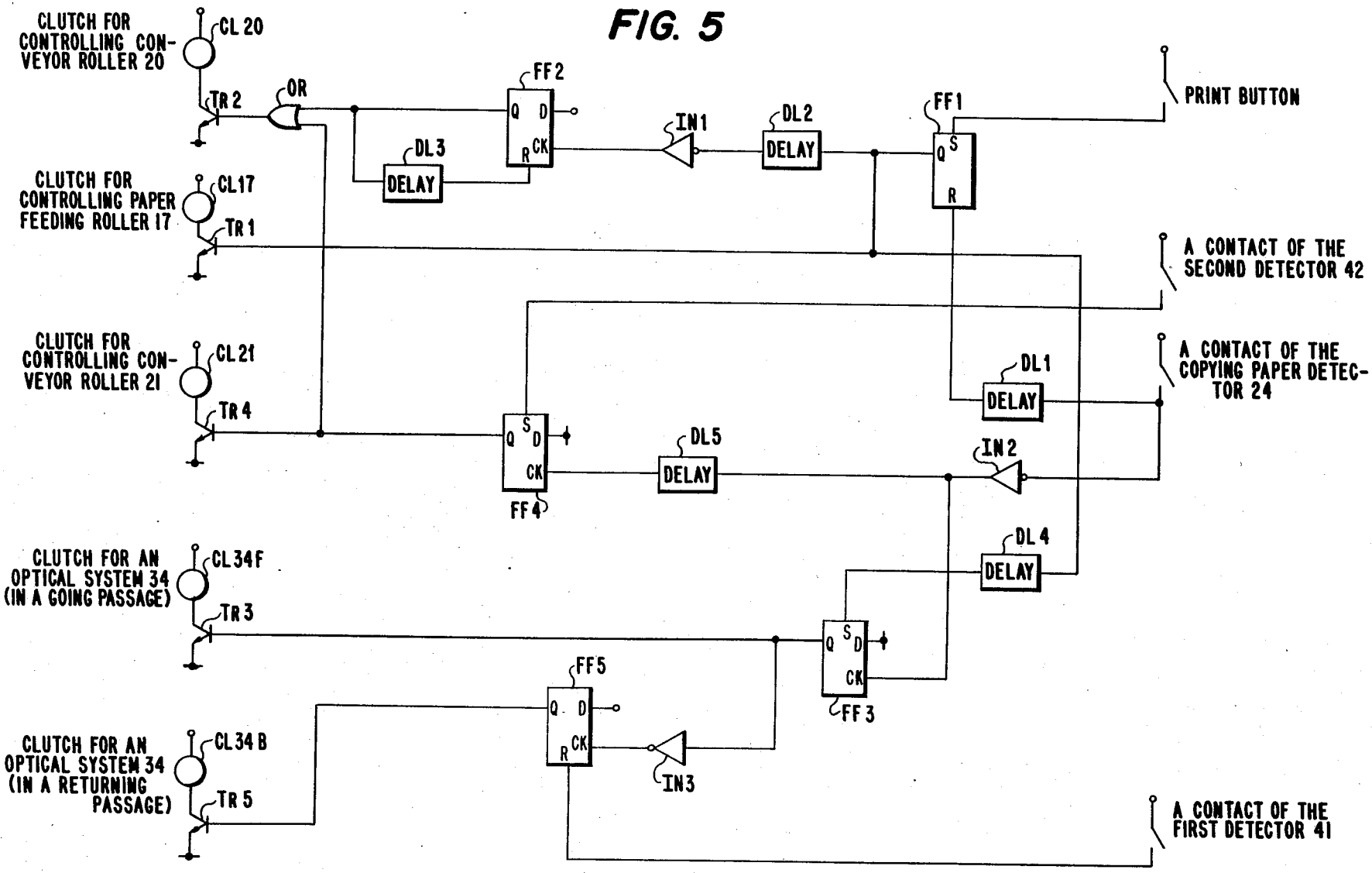
FIG. 5 is a circuit diagram of the electrical circuit according to the present invention.

Referring to FIG. 5, FF1 designates a flip-flop of the RS time; FF2 to FF5 designates flip-flops of the D type with an edge trigger; DL1 to DL5 designate delay circuits; Tr1 to Tr5 designate transistors used as switching elements; IN1 to IN3 designate inverters; OR designates an OR circuit; CL17 designates a clutch for controlling the paper feeding roller 17; CL20 designates a clutch for controlling the conveying roller 20; CL21 designates a clutch for controlling the conveying roller 21; CL34F designating a clutch for the optical system 34 (in a going passage), and CL34B designates a clutch for the optical system 34 (in a returning passage).

As soon as a print button is pushed to switch the system on, an ON-signal is fed to an S-terminal of the flip-flop FF1 and a high level signal (hereinafter referred to as an H-signal) is output from a Q-terminal of said flip-flop FF1.

On receiving this H-signal, the transistor Tr1 is switched on and the clutch CL17 for controlling the paper feeding roller 17 is driven into the "IN"-state, whereby the paper feeding roller 17 begins to rotate, so that a copying paper 16A is sent out from a cassette 15.

As soon as the top of said copying paper 16A is engaged with an actuator of the copying paper detector 24, said detector 24 is switched on.

An "ON"-signal (high level) of said detector 24 is fed to an R-terminal of the flip-flop FF1 through said delay circuit DL1 after the appointed time from the switching on action of said detector 24. Since said paper feeding roller 17 continues to rotate for the appointed time while said conveying roller 20 is stopped even though said detector 24 is switched on, said copying paper 16A forms a deflection $T_1$ under the condition that it is engaged with said conveying roller 20.

Said appointed time is set to a time of such an extent that said copying paper 16A may be engaged with said conveying roller 20 to form the appointed deflection $T_1$ at the upper reach side thereof.

As soon as an output of said delay circuit DL1 is fed to said R-terminal of said flip-flop FF1, a low level signal (hereinafter referred to as an L-signal) is output from said Q-terminal of said flip-flop FF1. Said transistor Tr1 is switched off by this L-signal and said clutch 17 for controlling the paper feeding roller is driven into an OUT-state, whereby said paper feeding roller 17 is stopped.

On the other hand, an L-signal from said Q-terminal of said flip-flop FF1 is fed to said inverter IN1 through said delay circuit DL2 after the appointed time and an H-signal from said inverter IN1 is fed to a CK-terminal of said flip-flop FF2.

Accordingly, since said flip-flop FF2 outputs an H-signal from a Q-terminal thereof and this H-signal is fed to said transistor Tr2 through said OR circuit OR, said transistor Tr2 is switched on and said clutch CL20 for controlling the conveying roller 20 is driven into an "IN"-state, whereby said conveying roller 20 begins to rotate to further convey said copying paper 16A, which has been stopped, toward the lower reach side.

An H-signal from a Q-terminal of said flip-flop FF2 is fed to an R-terminal of said flip-flop FF2 through said delay circuit DL3 after the appointed time. Said appointed time is set to a time of such an extent that said copying paper 16A may be conveyed to said conveying roller 21, which stands in the further lower reaches of said conveying roller 20, by the rotation of said conveying roller 20 to engage with said conveying roller 21 which has been stopped, whereby said copying paper 16A forms a deflection $T_2$ in the upper reaches of said conveying roller 21.

Thus, said copying paper 16A forms the appointed deflection $T_2$ in the upper reaches of said conveying roller 21.

As soon as an output of said delay circuit DL3 is fed to an R-terminal of said flip-flop FF2, said flip-flop FF2 outputs an L-signal from a Q-terminal thereof. Since this L-signal is fed to said transistor Tr2 through said OR circuit OR, said transistor Tr2 is switched off and said clutch CL20 for controlling a conveying roller 20 is driven into an OUT-state, whereby said conveying roller 20 is stopped.

On the other hand, when an output from a Q-terminal of said flip-flop FF1 is an H-signal, this H-signal is put in an S-terminal of said flip-flop FF3 through said delay circuit DL4 after the appointed time. Said copying paper 16A having said deflection $T_2$ awaits for said conveying roller 21 to begin to rotate for said appointed time.

As soon as an H-signal is fed to said S-terminal of said flip-flop FF3, an H-signal is output from a Q-terminal of said flip-flop FF3, whereby said transistor Tr3 is switched on and said clutch CL34F for use in an optical system 34 (in a forward passage) is driven into an "IN"- state, and as a result thereof, the optical system 34 begins to move in the forward direction.

As soon as said optical system 34 begins to move in the forward direction, the second detector 42 for use in an optical system is switched on, an "ON"-signal being fed to an S-terminal of said flip-flop FF4, and an H-signal being output from a Q-terminal of said flip-flop FF4. Since this H-signal is fed to said transistor Tr2 (through said OR circuit OR) and said transistor Tr4, respectively, both said transistor Tr2 and said transistor Tr4 are switched on and said clutch CL20 for controlling the conveying roller 20 and said clutch CL21 for controlling the conveying roller 20 are driven into an "IN"-state, respectively, whereby both said conveying roller 20 and said conveying roller 21 begin to rotate.

Although said copying paper 16A, which has been engaged with said conveying roller 21 and stopped, is conveyed toward a photoreceptor by rotation of said conveying rollers 20 and 21, when the rear end of said copying paper 16A leaves an actuator of said copying paper detector 24, said detector 24 is switched off and an "OFF"-signal (low level) of said detector 24 is fed to said inverter IN2, where it is inverted, and then fed to a CK-terminal of said flip-flop FF4 through said delay circuit DL5 after the appointed time. Said appointed time is set to a time of such an extent that the rear end of said copying paper 16A can finish the passage thereof through said conveying roller 21 after leaving an actuator of said copying paper detector 24 (noting that at this time, said detector 24 is switched off).

As soon as an input is fed to a CK-terminal of said flip-flop FF4, an L-signal is output from a Q-terminal of said flip-flop FF4. Since this L-signal is fed to said transistor Tr2 (through said OR circuit OR) and said transistor Tr4, respectively, both said transistor Tr2 and said transistor Tr4 are switched off and said clutches CL20 and CL21 for controlling their respective conveying rollers are driven into their OUT-state, whereby said conveying rollers 20 and 21 are stopped together.

On the other hand, as described above, since, when said copying paper detector 24 is switched off, an "OFF" signal thereof is also fed to a CK-terminal of said flip-flop FF3 through said inverter IN2, an L-signal is output from a Q-terminal of said flip-flop FF3 so as to switch off said transistor Tr3, and as a result thereof, said clutch CL34F for use in an optical system 34 is driven into an OUT-state, whereby the movement of said optical system 34 in the forward direction is stopped.

Since an L-signal from a Q-terminal of said flip-flop FF3 is fed to said inverter IN3 and an H-signal is simultaneously fed to a CK-terminal of said flip-flop FF5 from said inverter IN3, an H-signal is output from a Q-terminal of said flip-flop FF5. Said transistor Tr5 is switched on by this H-signal and said clutch CL34B for use in an optical system 34 (in the backward passage) is driven into an "IN"-state, whereby said optical system 34 begins to move in the backward direction.

As soon as said optical system 34 returns to a home position HP thereof, said first detector 41 for use in an optical system 34 is switched on, and an "ON"-signal of said detector 41 is fed to an R-terminal of said flip-flop FF5, and an L-signal is output from a Q-terminal of said flip-flop FF5. Said transistor Tr5 is switched off by this L-signal and said clutch CL34B for use in an optical system 34 is driven into an OUT-state, whereby said optical system 34 stands still at the appointed position HP.

We claim:

1. A method of feeding and conveying and correcting a position of an edge of a copying paper for use in a copyng machine provided with at least two pairs of conveying rollers on a conveying passage of said copying paper prior to a transferring process of the copying machine, wherein a paper feeding means and the conveying rollers are driven synchronously with the driving of an optical system of the copying machine so that the position of the top edge of the copying paper is to be at least twice corrected by making the top edge of the copying paper contact the at least two pair of conveying rollers so as to cause the copying paper to make at least two deflections, wherein the copying paper is once deflected while being conveyed by the paper feeding means and one of the at least two pairs of conveying rollers and is deflected a second time while being conveyed by two of the at least two pairs of conveying rollers; wherein the first deflection is effected by operating the paper feeding means for a period of time when one of the at least two pair of conveying rollers is stopped and the second deflection is effected by operating one of the at least two pair of conveying rollers for a period of time when another of the at least two pair of conveying rollers is stopped.

2. A method of feeding and conveying and correcting a position of an edge of a copying paper for use in a copying machine as set forth in claim 1, wherein the copying paper is deflected by contacting the pair of conveying rollers most near the transferring position and the pair of conveying rollers disposed directly before the pair conveying rollers most near the transferring position, respectively.

3. An apparatus for feeding and conveying a copying paper for use in a copying machine provided with at least two pairs of conveying rollers on a conveying passage prior to a transferring process of said apparatus, wherein a copying paper detector for detecting a copying paper fed from a paper feeding means is provided somewhat upstream from said pairs of conveying rollers of an upper reach side for providing a first deflection of said copying paper, said pair of conveying rollers of said upper reach side being disposed in the upper reaches of the conveying direction, the top of said copying paper contacting said pair of conveying rollers of said upper reach side by means of said paper feeding means and said pair conveying rollers of said upper reach side on the basis of a signal from said copying paper detector so as to provide a first certain definite deflection to said copying paper, whereby the position of the top of said copying paper is once corrected, and wherein a second certain definite deflection is provided to said copying paper when the top of said copying paper is brought into contact with said pair of conveying rollers of a lower reach side nearest the transferring position, whereby the positional state of the top of said copying paper is again corrected, and wherein said pair of conveying rollers of said lower reach side are driven synchronously with the drive of an optical system of said apparatus for exposing manuscript; wherein said first certain deflection is effected by operating said paper feeding means for a period of time when one of said at least two pair of conveying rollers is stopped and said second certain deflection is effected by operating one of said at least two pair of conveying rollers for a period of time when another of said at least two pair of conveying rollers is stopped.

* * * * *